United States Patent [19]

Adkins et al.

[11] 4,098,073

[45] Jul. 4, 1978

[54] FLUID FLOW DIFFUSER

[75] Inventors: Richard Cyril Adkins, Bedford; James Oswald Yost, Bristol, both of England

[73] Assignee: Rolls-Royce Limited, Great Britain

[21] Appl. No.: 779,553

[22] Filed: Mar. 21, 1977

[30] Foreign Application Priority Data

Mar. 24, 1976 [GB] United Kingdom ..... 11778/76

[51] Int. Cl.[2] ..... F02C 3/10

[52] U.S. Cl. ..... 60/39.16 R; 60/39.65; 415/DIG. 1; 138/39

[58] Field of Search ..... 60/39.16 R, 39.65; 415/182, 207, 213 C, DIG. 1; 138/39

[56] References Cited

U.S. PATENT DOCUMENTS

| | | | |
|---|---|---|---|
| 2,841,182 | 9/1958 | Scala | 415/DIG. 1 |
| 3,000,401 | 9/1961 | Ringleb | 415/DIG. 1 |
| 3,216,455 | 11/1965 | Cornell et al. | 138/39 |

FOREIGN PATENT DOCUMENTS

| | | | |
|---|---|---|---|
| 1,264,360 | 3/1968 | Fed. Rep. of Germany | 415/DIG. 1 |
| 580,841 | 9/1946 | United Kingdom | 415/DIG. 1 |

*Primary Examiner*—Louis J. Casaregola

*Attorney, Agent, or Firm*—Stevens, Davis, Miller & Mosher

[57] ABSTRACT

Fluid flow diffuser has a first divergent duct connected by a sudden enlargement of flow area to a second divergent duct. The enlargement is defined by a fence situated downstream of the downstream end of the first duct. The top of the fence is on a flow perimeter intermediate between the downstream end of the first duct and the upstream end of the second duct, the latter end being defined by the bottom of the fence. An opening defined by the downstream end of the first duct and by the top of the fence gives access to a chamber connected to a pressure less than that at latter downstream end thereby to generate a vortex having a surface bridging the opening and assisting transition of flow from the first duct to the top of the fence. A second vortex formed immediately downstream of the fence assists transition of flow from the top of the fence to the surface of the second duct. The first duct has a rate of divergence low enough to avoid boundary separation. The second duct has a rate of divergence greater than at boundary layer separation would normally occur. The arrangement described avoids boundary layer separation in the second duct and leads overall to a relative reduction in the length of the diffuser for a given rate of diffusion or a relative increase in the rate of diffusion for a given diffuser length.

4 Claims, 4 Drawing Figures

FLUID FLOW DIFFUSER

This invention relates to fluid flow diffusers.

According to this invention there is provided a fluid flow diffuser comprising a first and a second divergent duct connected in flow series, the first being divergent at a rate less than that at which boundary layer separation occurs, the upstream end of the second duct having a flow perimeter substantially larger than the flow perimeter of the downstream end of the first duct thereby to define a sudden enlargement of flow area between the ducts wherein the sudden enlargement is defined by a fence situated downstream of the downstream end of the first duct, the bottom of the fence defines the upstream end of the second duct, the top of the fence is situated at a low perimeter intermediate between those of the adjacent ends of the two ducts, a chamber is provided at the outside of the first duct at the downstream end thereof, an opening having access to said chamber is defined between the downstream end of the first duct and the top of the fence, means are provided for reducing the static pressure in the chamber to below that at the end of the first duct thereby to facilitate the formulation of a vortex in the chamber, and the second duct has a rate of divergence greater than that at which boundary layer separation would normally occur.

Examples of a diffuser according to this invention will now be described with reference to the accompanying drawings wherein.

Figure 1:
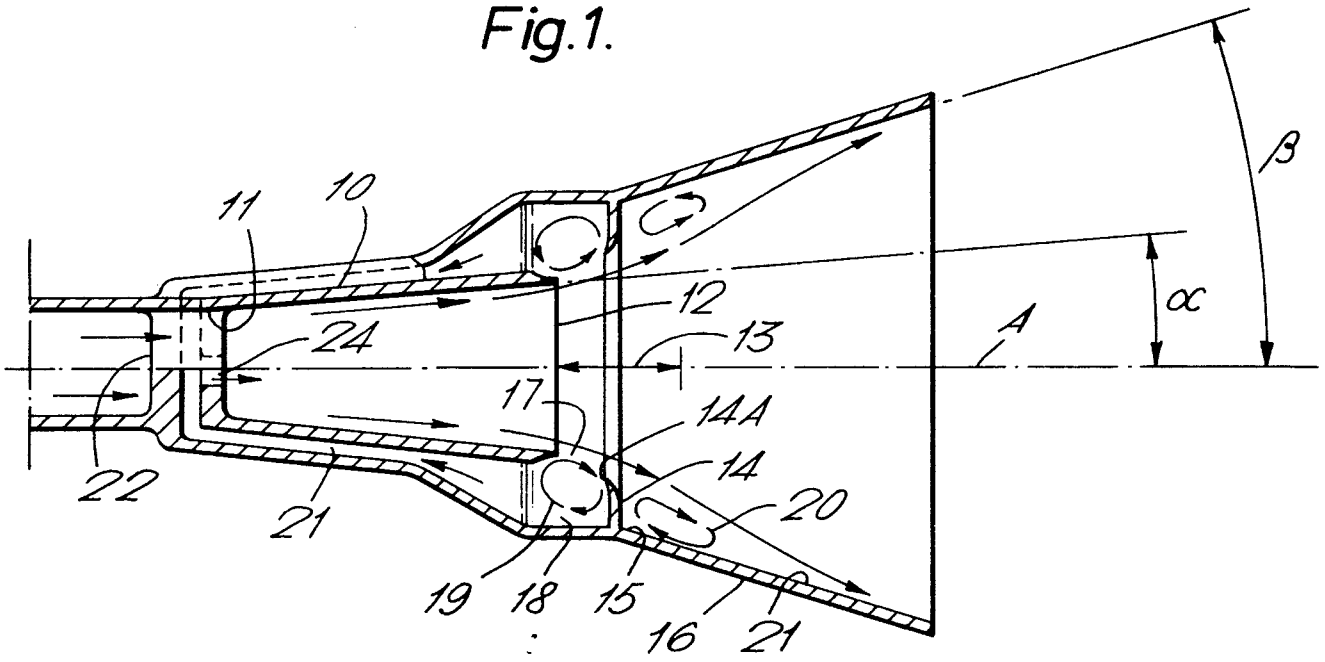
FIG. 1 is a sectional elevation of a diffuser according to a first example.

Referring to FIG. 1, the diffuser is generally symmetrical about an axis A defining the mean direction of flow through the diffuser. The diffuser comprises a first conical duct 10 having a gradual enlargement of flow area from an upstream end 11 to a downstream end 12 at a rate close to that at which boundary layer separation would occur. Downstream of the end 12 there is sudden enlargement of flow area transversely to the axis A. The enlargement extends over an axial region 13 and is essentially defined by a fence 14 situated downstream of the end 12 and whose free edge 14A is situated on a flow perimeter intermediate between the end 12 and the commencement, denoted 15, of a second conical duct 16. Between the end 12 and the free edge 14A of the fence there is an opening 17 to a chamber 18. The flow from the duct 10 across the opening 17 gives rise to the creation in the chamber of a usually toroidal vortex 19.

Immediately downstream of the fence 14, i.e. in the corner between the fence and the commencing portion of the duct 15 the flow from the duct 10 to the duct 16 gives rise to a second toroidal vortex 20. The vortices 19,20 combine to diffuse the flow through the region 13 to such an extent that the flow becomes attached to the wall of the duct 16 as shown at 21 and that the rate of diffusion of the duct 16 can be greater than that of the duct 10 at least over a limited downstream extent.

More specifically, the duct 10 has a cone angle $\alpha$ of about 10° which is below that at which boundary layer separation occurs. On the other hand, the duct 16 has a cone angle $\beta$ of over 15° which is above that at which normally boundary separation would occur. By virtue of the construction at the region 13 boundary layer separation in the duct 16 does in fact not occur and the overall rate of diffusion of the system defined by the ducts 10,16 and the region 13 is in fact as if diffusion had taken place in a stable way through a duct having a cone angle of substantially greater than 15°.

In order to establish good stability in the vortex 18 it is necessary to bleed some flow from the chamber 18. To this end the chamber is connected by a duct 21 to the upstream end of the duct 10 and where the duct is led into a diametral vane 22 having an outlet 24 into the centre of the duct 10. Since the duct 10 is divergent the static pressure at the end 11 is by definition less than that at the outlet end 12 and the opening 17 so that flow takes place through the duct 21 into the upstream end of the duct 10.

In cases where the pressure in the region 13 is greater than atmospheric the bleed from the chamber 18 may be direct to atmosphere.

Figure 2:
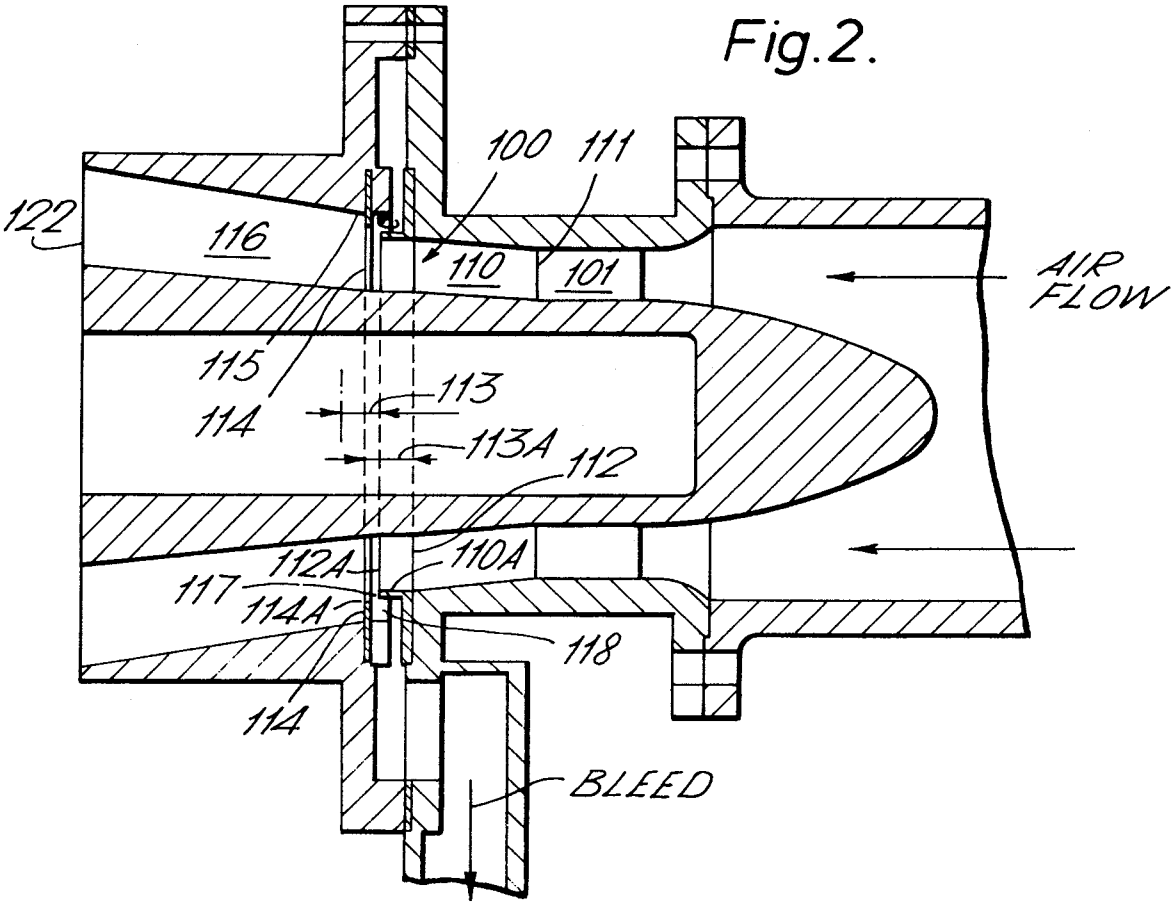
FIG. 2 is a sectional elevation of a diffuser according to a second example.

The example shown in FIG. 2 is generally similar to that shown in FIG. 1 but whereas FIG. 1 showed a conical diffuser, FIG. 2 shows an annular diffuser.

Referring to FIG. 2 the diffuser has an annular flow passage 100 starting with a parallel-sided duct 101 followed in flow-series by a divergent duct 110 terminating at an end 112 downstream of which there is a short parallel duct 110A (which is a matter of convenience of construction) followed by a sudden enlargement of flow area at a region 113 defined by a transition from a lip 112A across an opening 117 to a fence 114 situated downstream of the lip 112A and whose free edge 114A is situated on a flow perimeter intermediate between the lip 112A and the commencement, denoted 115, of a second duct 116. The opening 117 leads to an annular chamber 118 connected to a source of static pressure lower than that obtaining, in operation, at the end 112 or lip 112A. The duct 116 is divergent at a rate greater than that of the duct 110.

Referring now in detail to the rate of diffusion through the passage 100, it is explaned that although the diffuser is an annular diffuser it is customary to quote rates of diffusion in terms of an equivalent cone diffuser by referring to the so-called "equivalent cone angle", and this will be done in the following text.

In the following description of further details reference is made to the "equivalent cone angles" of the ducts 110,116. This is a term which is usual for annular diffusers because in such diffusers there is no single angle which can be used as a reference. The "equivalent" angle is that of a simple conical duct, e.g. the duct 10 in FIG. 1, of the same rate of divergence of the flow area.

The parallel-sided duct 101 clearly has an equivalent cone angle of zero. This duct is merely used to form an inlet for the diffuser proper.

The duct 110 has a "safe" rate of diffusion, that is a rate just below that at which boundary lay separation occurs. In the experiment represented by FIG. 2 the equivalent safe cone angle of the duct 110 was 10.1°. By virtue of the vortices formed in operation in the chamber 113 and at the commencement 115 of the duct 116 the flow mechanism in the region 113 was such that it became possible for the duct 116 to have an equivalent cone angle of 15.5°, that is an angle substantially in excess of that at which boundary layer separation occurs. The total equivalent cone angle of the diffuser, that is from the commencement 111 of the duct 110 to the end 122 of the duct 116 was found to be 20.1°. This is nearly twice the value of the safe angle of 10.1° of the duct 110 and resulted in a correspondingly low overall length of the diffuser. The total angle was established experimentally on trying progressive modifications of the region 113.

It is broadly sufficient to define the diffuser in terms of the relative rates of diffusion of the ducts 110, 116. This relationship is of course determined by the effectiveness of the flow mechanism in the region 113 which is in turn determined by the geometry of this region and the pressure drop across the opening 117. The most favourable geometry of the region depends on experimentally established detail but it may broadly be defined in terms of an equivalent cone angle either of the region 113 as a whole or of the equivalent cone angle of a region 113A between the end 112 and the lip 114A. In the above experiment the equivalent cone angle of the region 113A was 33.6°.

Figure 3:
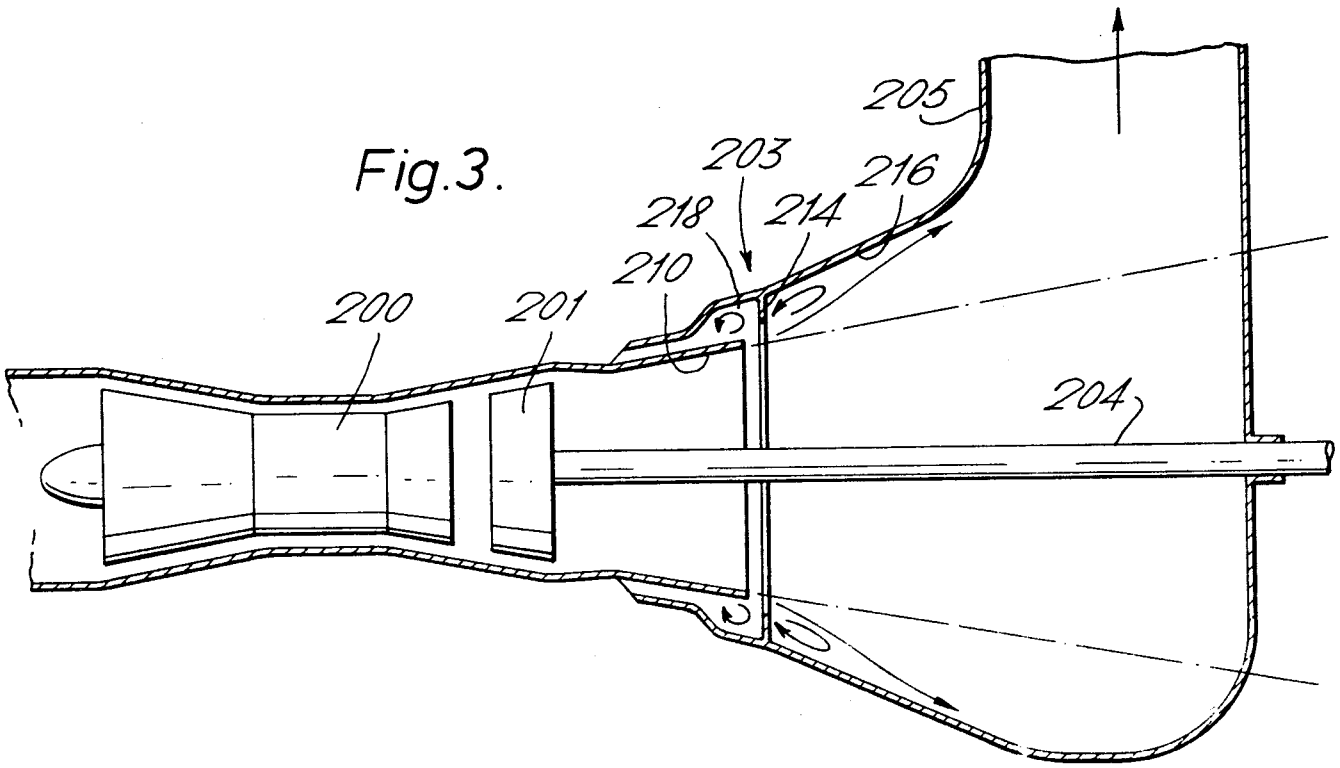
FIG. 3 is a sectional elevation of a stationary gas turbine installation embodying a diffuser according to this invention.

FIG. 3 shows a diffuser according to this invention applied to the exhaust system of a stationary gas turbine engine installation. The engine or gas generator, 200 drives a free power turbine 201 having an output shaft 204 and exhausts through a diffuser 203 having first and second conical ducts 210,216 between which is arranged an annular chamber 218 and a fence 214 all equivalent to the arrangement shown in FIG. 1. The diffuser 203 has an exhaust duct 205 laterally of the shaft 204. It will be known that such installations require a diffuser for the exhaust gases in order to increase the pressure drop across the free turbine and thereby raise the power output thereof. Clearly the axial or other length of such a diffuser can lead to problems especially in ship applications, and the diffuser according to this invention brings about a reduction in the length of the installation for a given rate of diffusion or an increase in the rate of diffusion for a given available length.

Figure 4:
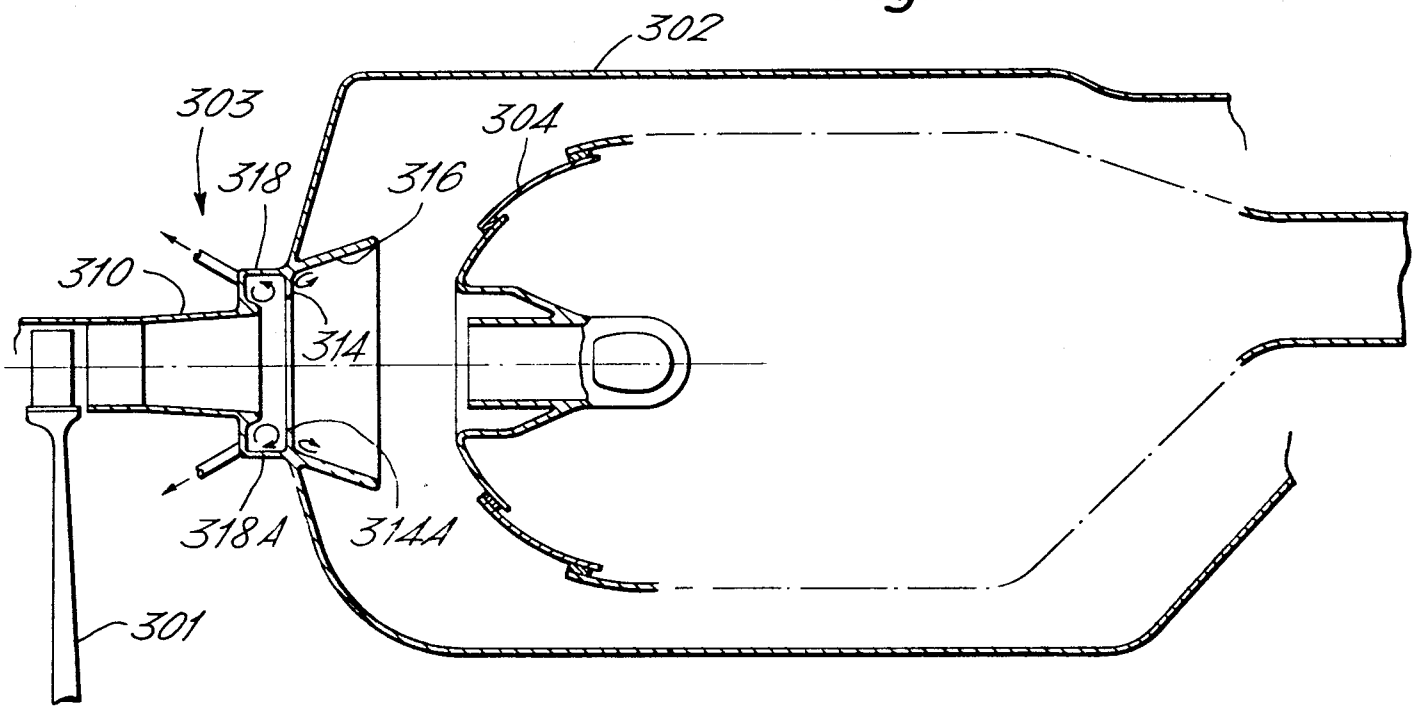
FIG. 4 is a sectional elevation of a part of a gas turbine engine embodying a diffuser according to this invention.

FIG. 4 shows a diffuser according to this invention as applied to the compressor deliver end of a gas turbine engine. An axial flow compressor 300 has an annular delivery duct 301 exhausting into a diffuser 303 having first and second annular divergent ducts 310,316 leading to an air casing 302 surrounding an annular combustion chamber 304. The ducts having between them inner and outer annular chambers 318,318A and repective fences 314,314A. The arrangement is equivalent to that shown in FIG. 2 except that in the present case an inner chamber, 314A, is provided in addition to the outer one. Also, the duct 316 ends at a so-called "dump diffuser" 306 defined by a free space 307 around the downstream end of the duct 316.

Here again the arrangement makes possible a higher rate of diffusion for a given axial length or a shorter installation for a given rate of diffusion.

In both the arrangements shown in FIGS. 4 and 5 the air bled from the vortex chamber 218,318 respectively may be ducted into the upstream end of the first diffuser duct 210,318 respectively substantially as shown in FIG. 1.

What we claim is:

1. Fluid flow diffuser comprising a first and a second divergent duct connected in flow series, the first duct being divergent at a rate less than that at which boundary layer separation occurs, the upstream end of the second duct having a flow perimeter substantially larger than the flow perimeter of the downstream end of the first duct thereby to define a sudden enlargement of flow area between the ducts wherein the sudden enlargement is defined by a fence situated downstream of the downstream end of the first duct, the bottom of the fence defines the upstream end of the second duct, the top of the fence is situated at a flow perimeter intermediate between those of the adjacent ends of the two ducts, a chamber is provided at the outside of the first duct at the downstream end thereof, an opening having access to said chamber is defined between the downstream end of the first duct and the top of the fence, means are provided for reducing the static pressure in the chamber to below that at the end of the first duct thereby to facilitate the formation of a vortex in the chamber, and the second duct has a rate of divergence greater than that at which boundary layer separation would normally occur.

2. Diffuser according to claim 1 wherein the chamber is connected to a location in the first duct at a point where the static pressure in the first duct is sufficiently low for the purpose of facilitating said formation of a vortex in the chamber.

3. Diffuser according to claim 1 in combination with a gas generator having a free power turbine having an exhaust duct comprising said first duct of the diffuser and said diffuser constituting an exhaust system for the turbine.

4. Diffuser according to claim 1 in combination with a gas turbine engine having an axial flow compressor having an annular delivery duct comprising said first duct of the diffuser, and wherein the second duct of the diffuser has an outlet into an air casing surrounding a combustion chamber of the engine.

* * * * *